US007231983B2

(12) United States Patent
Lequang et al.

(10) Patent No.: US 7,231,983 B2
(45) Date of Patent: Jun. 19, 2007

(54) SPLIT LOCKING RING FOR WELLHEAD COMPONENTS

(75) Inventors: Huy Lequang, Houston, TX (US); Joseph Shu Yian Liew, Singapore (SG); Brian J. Baca, Houston, TX (US); Hoa Ngoc Nguyen, Houston, TX (US); Kevin Kok Sum Lim, Singapore (SG)

(73) Assignee: FMC Technologies, Inc., Houston, TX (US)

( * ) Notice: Subject to any disclaimer, the term of this patent is extended or adjusted under 35 U.S.C. 154(b) by 0 days.

(21) Appl. No.: 10/752,160

(22) Filed: Jan. 6, 2004

(65) Prior Publication Data

US 2005/0145391 A1 Jul. 7, 2005

(51) Int. Cl.
*E21B 33/03* (2006.01)
*E21B 33/04* (2006.01)
*E21B 33/068* (2006.01)

(52) U.S. Cl. ..... 166/379; 166/378; 166/368; 166/75.13; 285/353; 285/415

(58) Field of Classification Search ..... 166/378, 166/379, 367, 368, 360, 75.13; 285/353, 285/414, 415
See application file for complete search history.

(56) References Cited

U.S. PATENT DOCUMENTS 1,913,030 A * 6/1933 Hux ..... 277/336
3,071,188 A * 1/1963 Raulins ..... 285/23
3,345,084 A * 10/1967 Hanes et al. ..... 285/27
3,933,202 A * 1/1976 Ahlstone ..... 166/182
4,209,193 A * 6/1980 Ahlstone ..... 285/309
4,496,173 A * 1/1985 Roche et al. ..... 285/24
4,610,465 A * 9/1986 Boyadjieff ..... 285/3
4,810,010 A * 3/1989 Jones ..... 285/55
4,830,408 A * 5/1989 Reimert ..... 285/27
4,976,458 A * 12/1990 Hosie et al. ..... 285/24
5,152,556 A * 10/1992 Holland et al. ..... 285/353
5,333,685 A * 8/1994 Gilbert ..... 166/123
5,631,563 A * 5/1997 Moriarty ..... 324/338
5,636,876 A 6/1997 Eidsmore ..... 285/39
5,685,574 A * 11/1997 Kohli et al. ..... 285/35
6,484,808 B2 * 11/2002 Jones et al. ..... 166/379
6,520,263 B2 * 2/2003 June ..... 166/368
6,666,272 B2 * 12/2003 Singeetham et al. ..... 166/345
6,920,925 B2 * 7/2005 Duhn et al. ..... 166/75.13

* cited by examiner

*Primary Examiner*—David Bagnell
*Assistant Examiner*—Shane Bomar
(74) *Attorney, Agent, or Firm*—Williams, Morgan & Amerson, P.C.

(57) ABSTRACT

The present invention is directed to a split locking ring for wellhead components. In one illustrative embodiment, the device comprises a first internally threaded wellhead component, a second wellhead component, at least a portion of which is positioned within an opening in the first wellhead component, and a rotatable split lock ring comprised of at least two externally threaded sections, wherein at least a portion of the sections of the split lock ring are positioned between the first and second wellhead components and rotated to threadingly couple the sections of the split lock ring to the first wellhead component and thereby secure the second wellhead component to the first wellhead component. In one illustrative embodiment, the method comprises positioning at least a portion of a first wellhead component within an opening in a second internally threaded wellhead component, positioning a split lock ring comprised of at least two externally threaded sections proximate the first and second wellhead components, and rotating the sections of the split lock ring to threadingly couple the externally threaded sections to the internally threaded second wellhead component and position at least a portion of the split lock ring sections between the first and second wellhead components, thereby securing the first wellhead component to the second wellhead component.

20 Claims, 3 Drawing Sheets

SPLIT LOCKING RING FOR WELLHEAD COMPONENTS

BACKGROUND OF THE INVENTION

1. Field of the Invention

The present invention is generally related to wellhead components, and, more particularly, to a split locking ring for wellhead components.

2. Description of the Related Art

Oil and gas well typically comprise a number of different components that must be coupled together. For example, such components can include a casing head, a Christmas tree, a tubing head, a blowout preventer, etc. There are many known methods for securing one well component to another. For example, externally mounted clamping devices, that may be actuated either hydraulically or mechanically, are well known in the art. Such devices are usually relatively large, heavy and expensive.

There are other methods of connecting such components together. For example, as shown in FIG. 1, a first component 12 is coupled to a second component 14 via a flanged connection 15. More specifically, the flange 17 of the first component 12 and the flange 18 of the second component 14 are provided with openings 19 wherein a plurality of bolts or studs 20 and nuts are used to secure the first component 12 to the second component 14. The first component 12 is secured to a third component 16 via a single piece lock ring 22. The single piece lock ring 22 has an internal lip 26 that is adapted to engage a surface 27 of a flange 28 of the first component 12. The single piece lock ring 22 is threadingly coupled to the flange 32 of the third component 16 via a plurality of threads 30 (internal threads on the lock ring 22 and external threads on the flange 32). By threadingly coupling the single piece lock ring 22 to the flange 32, the first component 12 and second component 14 are securely coupled to one another.

One problem with the single piece lock ring 22 depicted in FIG. 1 is that it must be physically large enough in diameter to fit over the flanged connection 15, e.g., the upper flange 18 of the second component 14, or any other features of the components 12, 14 as the single piece lock ring 22 is installed. In general, this design constraint requires that the flange 28 on the first component 12 be large enough in diameter, i.e., oversized, such that the single piece lock ring 22 may be made large enough to be readily installed over the first and second components 12, 14. The requirement to make the single piece lock ring 22 large enough to be positioned over the first and second components 12, 14 can create various problems. More specifically, among other things, requiring the use of an oversized single piece lock ring 22 means that the various components, e.g., flanges 28, 32, are larger and heavier than would otherwise be required and thus more costly to manufacture and handle. Moreover, the requirement that the single piece lock ring 22 be of a relatively large size can be problematic in some applications in which there is limited space available, e.g., such as in a multiple completion well.

The present invention is directed to an apparatus and methods for solving, or at least reducing the effects of, some or all of the aforementioned problems.

SUMMARY OF THE INVENTION

The present invention is directed to a split locking ring for wellhead components. In one illustrative embodiment, the device comprises a first internally threaded wellhead component, a second wellhead component, at least a portion of which is positioned within an opening in the first wellhead component, and a rotatable split lock ring comprised of at least two externally threaded sections, wherein at least a portion of the sections of the split lock ring are positioned between the first and second wellhead components and rotated to threadingly couple the sections of the split lock ring to the first wellhead component and thereby secure the second wellhead component to the first wellhead component.

In another illustrative embodiment, the device comprises a first internally threaded wellhead component, a second wellhead component, at least a portion of which is positioned within an opening in the first wellhead component, the second wellhead component having a flange, and a rotatable split lock ring comprised of two externally threaded sections, the sections having an end surface, wherein at least a portion of the sections of the split lock ring are positioned between the first and second wellhead components and rotated to threadingly couple the sections of the split lock ring to the first wellhead component and engage the end surface of the sections of the split lock ring with the flange on the second wellhead component, the sections thereby securing the second wellhead component to the first wellhead component.

In a further illustrative embodiment, the device comprises a first externally threaded wellhead component, an internally threaded sleeve threadingly coupled to the externally threaded first wellhead component, a second wellhead component, at least a portion of which is adapted to be positioned within an opening in the internally threaded sleeve, and a rotatable split lock ring comprised of at least two externally threaded sections, wherein at least a portion of the sections of the split lock ring are positioned between the internally threaded sleeve and the second wellhead component and rotated to threadingly couple the sections of the split lock ring to the internally threaded sleeve and thereby secure the second wellhead component to the first wellhead component.

In yet a further illustrative embodiment, the devices comprises a first externally threaded wellhead component, an internally threaded sleeve threadingly coupled to the externally threaded first wellhead component, the sleeve comprising a counterbore formed adjacent an end surface of the internally threaded sleeve, a second wellhead component, at least a portion of which is adapted to be positioned within an opening in the internally threaded sleeve, and a rotatable split lock ring comprised of at least two externally threaded sections, each of the sections having a flange, wherein at least a portion of the sections of the split lock ring are positioned between the internally threaded sleeve and the second wellhead component and rotated to threadingly couple the sections of the split lock ring to the internally threaded sleeve and thereby secure the second wellhead component to the first wellhead component, wherein at least a portion of the flange on each of the sections is positioned in the counterbore.

In one illustrative embodiment, the method comprises positioning at least a portion of a first wellhead component within an opening in a second internally threaded wellhead component, positioning a split lock ring comprised of at least two externally threaded sections proximate the first and second wellhead components, and rotating the sections of the split lock ring to threadingly couple the externally threaded sections to the internally threaded second wellhead component and position at least a portion of the split lock ring sections between the first and second wellhead components, thereby securing the first wellhead component to the second wellhead component.

In another illustrative embodiment, the method comprises positioning at least a portion of a first wellhead component within an opening in a second internally threaded wellhead component, the first wellhead component having a flange, positioning a split lock ring comprised of at least two externally threaded sections proximate the first and second wellhead components, and rotating the sections of the split lock ring to threadingly couple the externally threaded sections to the internally threaded second wellhead component and position at least a portion of the split lock ring sections between the first and second wellhead components, an end surface of each of the sections engaging the flange on the first wellhead component, the rotating of the sections being continued until the first wellhead component is securely coupled to the second wellhead component.

In a further illustrative embodiment, the method comprises threadingly coupling an internally threaded sleeve to an externally threaded first wellhead component, positioning at least a portion of a second wellhead component within an opening in the internally threaded sleeve, positioning a split lock ring comprised of at least two externally threaded sections proximate the internally threaded sleeve and the second wellhead component, and rotating the sections of the split lock ring to threadingly couple the sections to the internally threaded sleeve and position at least a portion of the split lock ring sections between the internally threaded sleeve and the second wellhead component, thereby securing the first wellhead component to the second wellhead component.

In yet a further illustrative embodiment, the method comprises threadingly coupling an internally threaded sleeve to an externally threaded first wellhead component, the internally threaded sleeve having a counterbore formed therein, positioning at least a portion of a second wellhead component within an opening in the internally threaded sleeve, the second wellhead component having a flange, positioning a split lock ring comprised of at least two externally threaded sections proximate the internally threaded sleeve and the second wellhead component, each of the sections having an end surface, and rotating the sections of the split lock ring to threadingly couple the sections to the internally threaded sleeve and position at least a portion of the split lock ring sections between the internally threaded sleeve and the second wellhead component, the end surfaces on the sections engaging the flange on the first wellhead component, the rotation being continued until such time as the first wellhead component is secured to the second wellhead component and at least a portion of a flange on each of the sections is positioned in the counterbore.

BRIEF DESCRIPTION OF THE DRAWINGS

The invention may be understood by reference to the following description taken in conjunction with the accompanying drawings, in which like reference numerals identify like elements, and in which.

Figure 4:
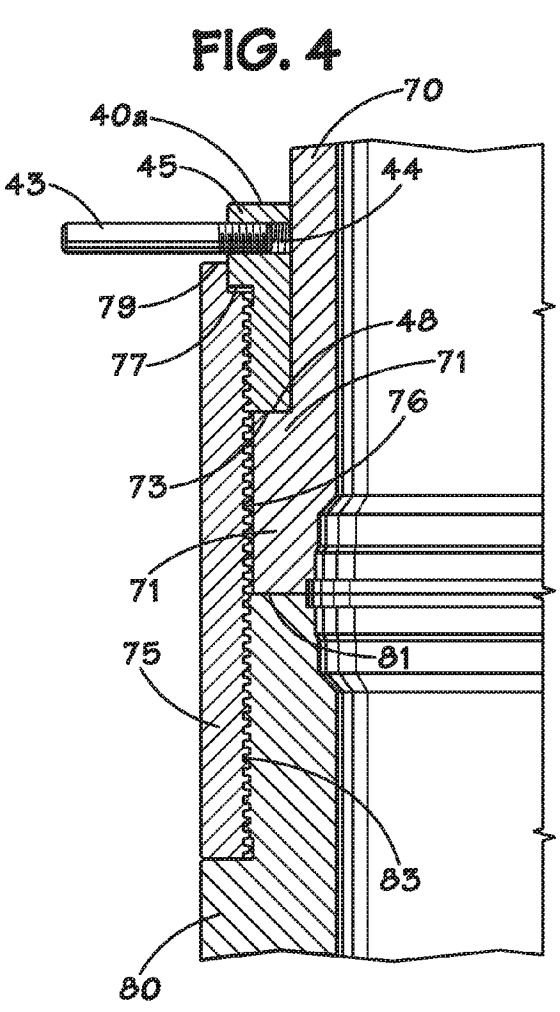
FIG. 4 depicts yet another illustrative embodiment of the present invention.
Figure 1:
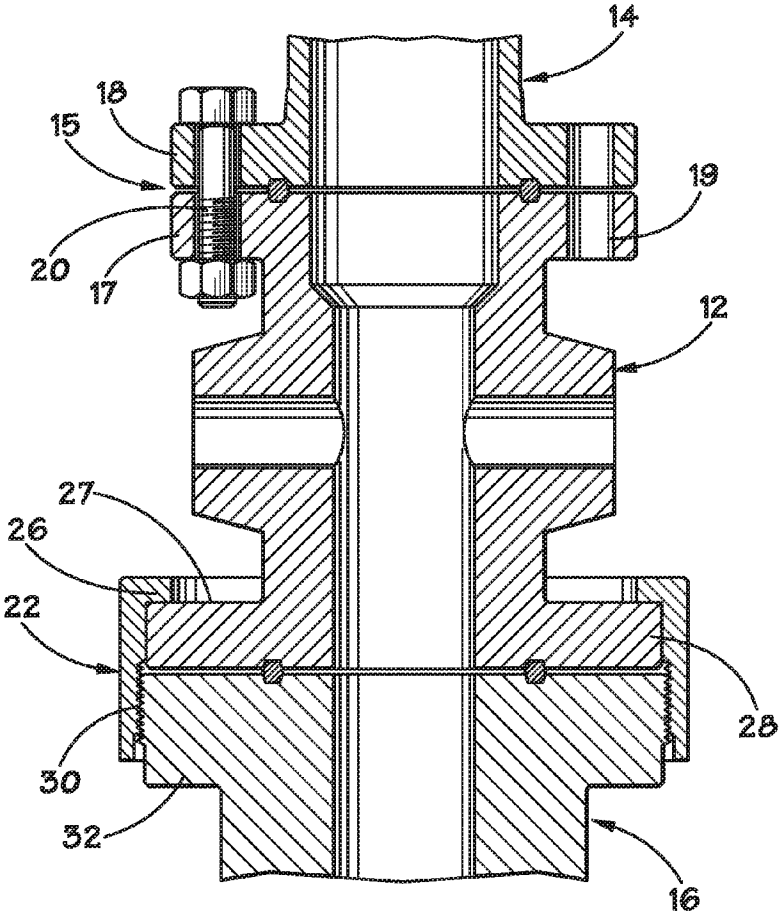
FIG. 1 (PRIOR ART)
FIG. 1 is an illustrative depiction of various wellhead components that may be coupled together in accordance with a variety of prior art methods and techniques.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF THE INVENTION

Illustrative embodiments of the invention are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The present invention will now be described with reference to the attached figures. The words and phrases used herein should be understood and interpreted to have a meaning consistent with the understanding of those words and phrases by those skilled in the relevant art. No special definition of a term or phrase, i.e., a definition that is different from the ordinary and customary meaning as understood by those skilled in the art, is intended to be implied by consistent usage of the term or phrase herein. To the extent that a term or phrase is intended to have a special meaning, i.e., a meaning other than that understood by skilled artisans, such a special definition will be expressly set forth in the specification in a definitional manner that directly and unequivocally provides the special definition for the term or phrase.

In general, the present invention is directed to a split lock ring that may be used in connecting various wellhead components to one another. As used herein, the term "wellhead components" should be understood to include any of a variety of devices that are associated with oil and gas wells, including, but not limited to, a casing head, a tubing head, a wellhead, a Christmas tree, a blowout preventer, a riser, a diverter, a wellhead or tree adapter, a connector, a tool joint, etc. As will be recognized by those skilled in the art after a complete reading of the present application, the present invention may be employed to couple a variety of such wellhead components to one another, and the split lock ring of the present invention may be comprised of multiple pieces. Thus, the particular wellhead components to be joined using the split lock ring of the present invention, or the number of segments of such a split lock ring, should not be considered a limitation of the present invention, unless such limitations are expressly set forth in the appended claims. Moreover, the present invention may be employed with sub-surface or surface wellhead components.

Figure 2B:
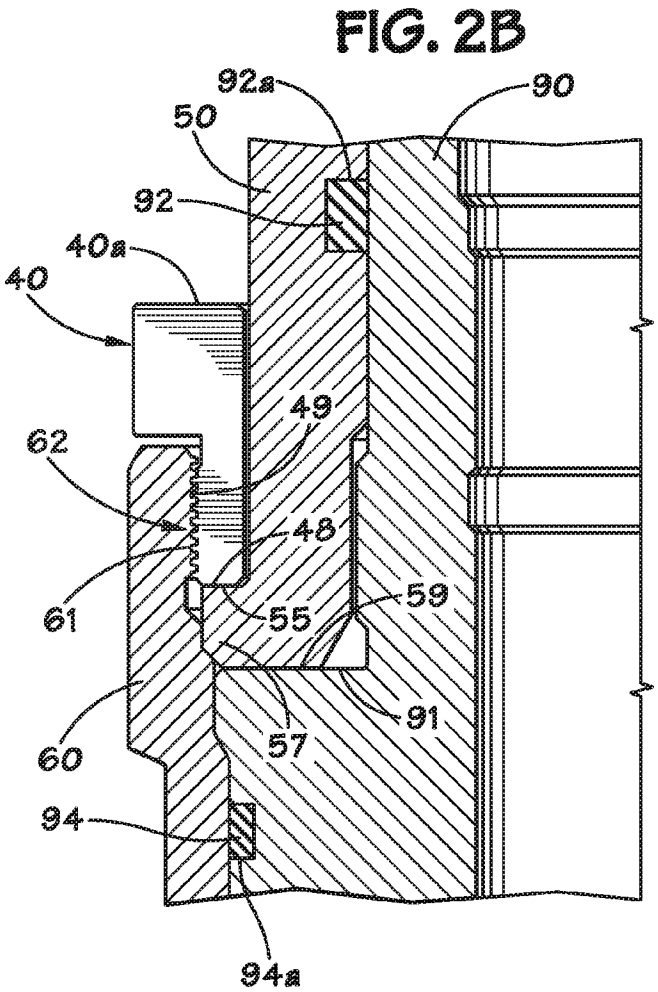
FIGS. 2A-2B depict one illustrative embodiment of the present invention wherein the split lock ring is employed to connect wellhead components to one another.
Figure 2A:
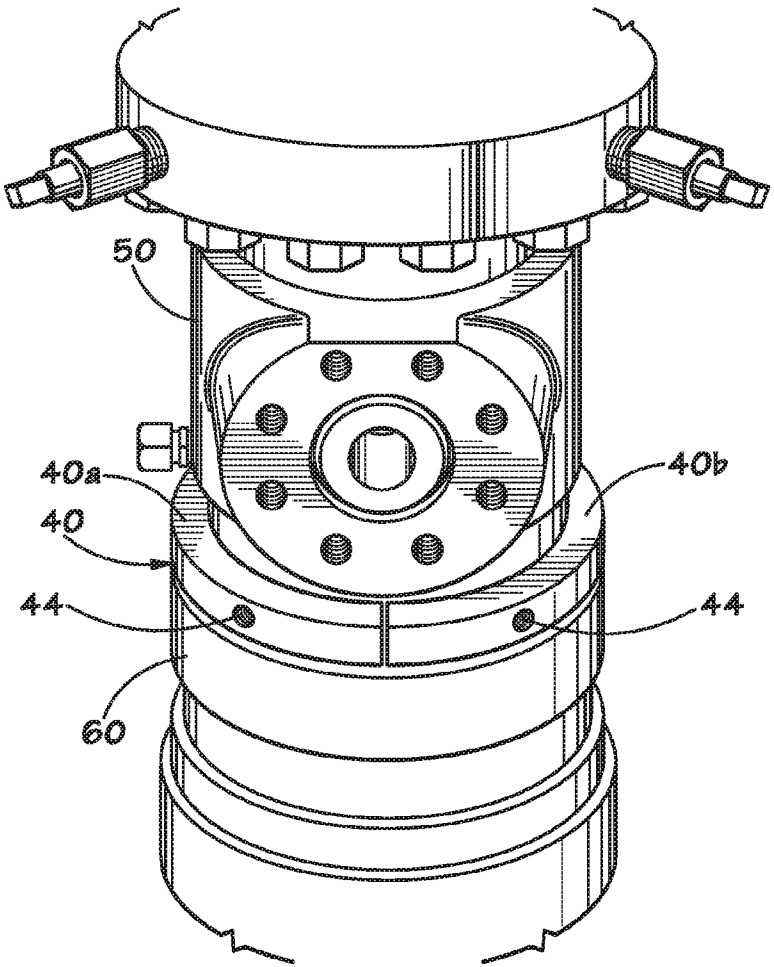

As depicted in FIGS. 2A and 2B, a split lock ring 40 of the present invention is employed to couple a first wellhead component 50 to a second wellhead component 60. In the depicted embodiment, the first wellhead component 50 may be, for example, a tubing head assembly, whereas the second wellhead component 60 may be, for example, a casing head. Of course, other wellhead components may be coupled to one another using the split lock ring 40 of the present invention. Thus, the particular type of components connected to one another should not be considered to be a limitation of the present invention, unless such limitations are clearly set forth in the appended claims. FIG. 2B is a cross-sectional view of a split lock ring 40, as installed, that is used to couple two wellhead components 50, 60 to one another. As shown in FIG. 2B, the first wellhead component 50 and the second wellhead component 60 interact with a third structure 90. A first seal 92 is provided between the first wellhead component 50 and the third structure 90. A second seal 94 is provided between the second wellhead component 60 and the third structure 90. The seals 92, 94 are at least partially positioned in recesses 92*a*, 94*a*, respectively.

Figure 3B:
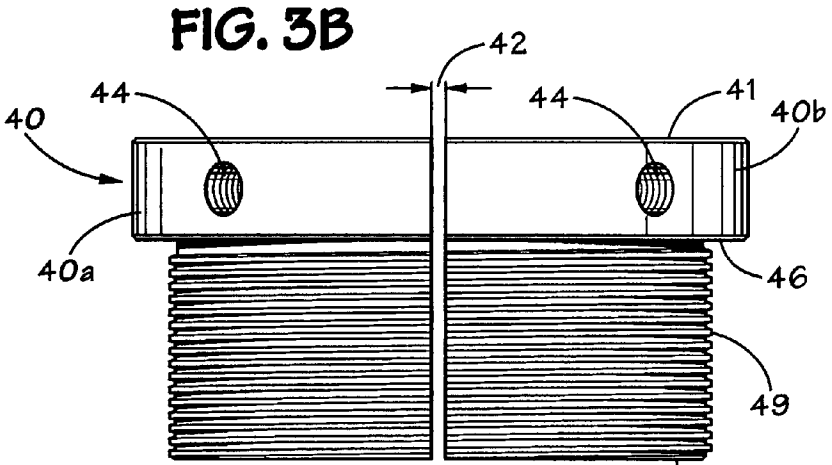
FIGS. 3A-3C are plan, front and cross-sectional side views, respectively, of one illustrative embodiment of a split lock ring in accordance with the present invention.
Figure 3C:
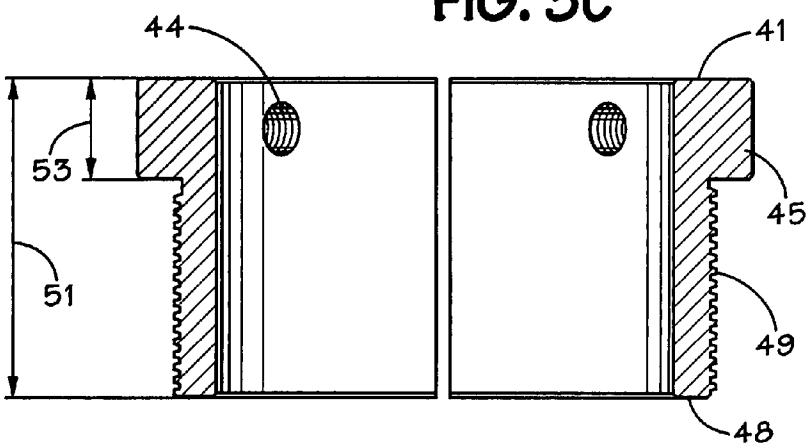
Figure 3A:
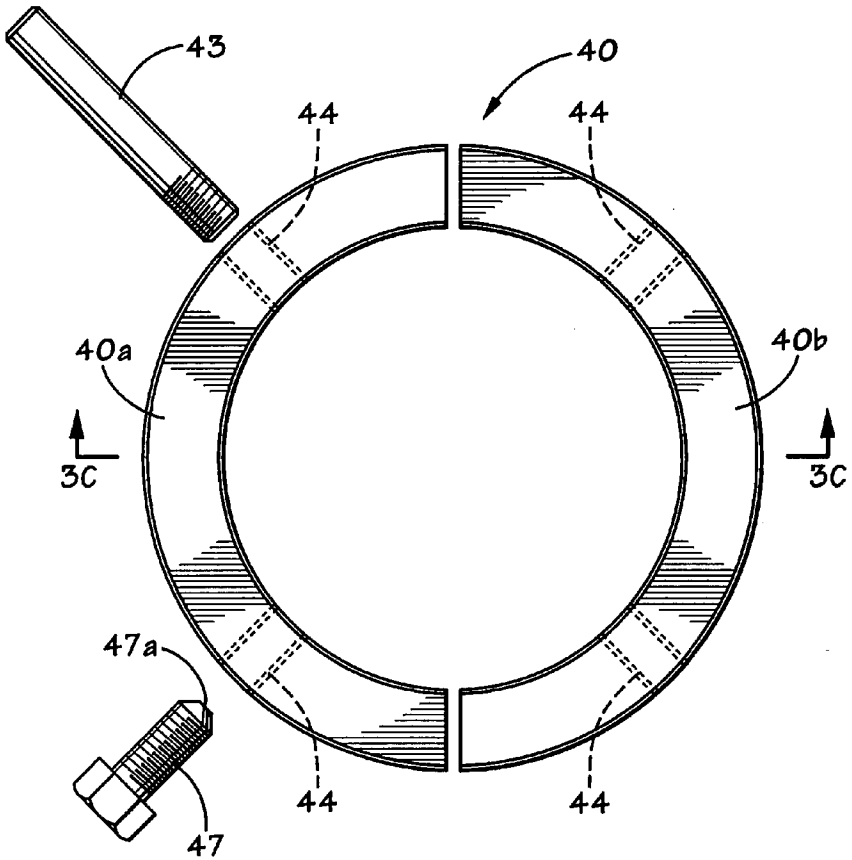

FIGS. 3A-3C are plan, front and cross-sectional side views, respectively, of one illustrative embodiment of the split lock ring 40 of the present invention. In one illustrative embodiment, the split lock ring 40 of the present invention is comprised of two sections 40*a*, 40*b*. However, the present invention is not so limited as the split lock ring 40 of the present invention may be comprised of more than two sections if desired, e.g., three sections. The split lock ring 40 of the present invention is comprised of a plurality of threaded openings 44, each of which are adapted to receive a threaded bar 43 and/or a set screw 47. Only one illustrative threaded bar 43 and set screw 47 are depicted in FIG. 3A. A plurality of the threaded bars 43 may be used to rotate the two sections 40*a*, 40*b* of the split lock ring 40. The set screw 47 has an end surface 47*a* that is adapted to engage a portion or surface of the first wellhead component 50 when the set screw 47 is completely installed in the threaded opening 44. The split lock ring 40 sections 40*a*, 40*b* comprise a flange 45 having a top surface 41, a bottom surface 46, an end surface 48 and external threads 49. In the embodiment depicted in FIGS. 2A and 2B, the external threads 49 on the split lock ring 40 are adapted to threadingly engage internal threads 61 formed on the component 60 (see FIG. 2B). In the depicted embodiment, the threads 49, 61 are right-hand, standard ACME threads with an illustrative pitch of approximately four threads per inch.

The physical dimensions of the split lock ring 40 of the present invention may vary depending upon the particular application. In general, the components of the split lock ring 40 should be sized and configured to withstand the anticipated loadings to be applied to the split lock ring 40. In one illustrative embodiment, the axial length 51 (see FIG. 3C) of the split lock ring 40 may range from approximately 3-4 inches and the flange 45 may have thickness 53 that ranges from approximately 1.5-2.0 inches. When installed, the gap 42 between the sections 40*a* and 40*b* of the split lock ring 40 may be approximately 0.125 inches. The threaded holes 44 may have a diameter of approximately 1 inch. Of course, the present invention should not be considered as limited to a split lock ring 40 having such physical dimensions, unless such limitations are expressly set forth in the appended claims.

With respect to the embodiment depicted in FIGS. 2A-2B, at least a portion of the first wellhead component 50 may be positioned within the opening defined by the second wellhead component 60. Thereafter, the externally threaded sections 40*a*, 40*b* of the split lock ring 40 are threadingly engaged with the internally threaded portion of the second wellhead component 60. To threadingly couple the split lock ring 40 to the second component 60, a plurality of the threaded bars 43 may be inserted into the threaded openings 44 and used to rotate the split lock ring sections 40*a*, 40*b* as required. This rotation is continued until such time as the end surfaces 48 of the split lock ring sections 40*a*, 40*b* engage a surface 55 on a flange 57 of the first wellhead component 50. An engagement surface 59 of the first wellhead component 50 engages and engagement surface 91 of the third structure 90. The split lock ring sections 40*a*, 40*b* are further tightened until such time as the first wellhead component 50 is properly seated within the second wellhead component 60. At that time, the threaded bars 43 may be removed from the threaded openings 44. Thereafter, the threaded set screws 47 may be positioned in the threaded openings 44 and tightened until the end surface 47*a* of the set screws 47 engage a surface or portion of the first wellhead component 50. The set screws 43 are employed to further secure the split lock ring 40 sections 40*a*, 40*b* in the installed position.

FIG. 4 depicts yet another illustrative embodiment of the present invention. As shown therein, a first wellhead component 80, e.g., a wellhead, is adapted to be coupled to a second wellhead component 70, e.g., a riser body. In this embodiment, an internally threaded sleeve 75, comprised of internal threads 76, is employed in connection with the split lock ring 40 of the present invention. More specifically, the internally threaded sleeve 75 is adapted to be threadingly coupled to the external threads 83 formed on the first wellhead component 80. A counterbore 77 is formed in the upper end 79 of the threaded sleeve 75. Note that, the end surface 79 of the threaded sleeve 75 extends above the end surface 81 of the first wellhead component 80.

Initially, the sleeve 75 is threadingly coupled to the first wellhead component 80. Then, at least a portion of the second wellhead component 70 is positioned within the opening in the internally threaded sleeve 75. Note, that the second wellhead component 70 in this illustrative embodiment does not have any external threads for mating with the internal threads 76 on the internally threaded sleeve 75. The split lock ring sections 40*a*, 40*b* are positioned between the second wellhead component 70 and the sleeve 75. Then, the sections 40*a*, 40*b* are rotated (using the threaded bars 43 positioned in the threaded openings 44) to threadingly couple the externally threaded sections 40*a*, 40*b* with the internally threaded sleeve 75, i.e., the split lock ring segments 40*a*, 40*b* are rotated to thereby engage the external threads 49 on the split lock ring segments 40*a*, 40*b*, with the internal threads 76 on the threaded sleeve 75. The split lock ring segments 40*a*, 40*b* are rotated until such time as the end surfaces 48 of the split lock ring sections 40*a*, 40*b* engage a surface 73 on a flange 71 of the second wellhead component 70. Tightening of the split lock ring segments 40*a* 40*b* is continued until the first and second wellhead components 80, 70 are properly coupled to one another. The threaded bars 43 may then be removed. Thereafter, the threaded set screws 47 may be positioned in the threaded openings 44 to secure the split lock ring sections 40*a*, 40*b* in the installed position. In some embodiments, at least a portion of the flange 45 of the split lock ring sections 40*a*, 40*b* is positioned in the counterbore 77 in the threaded sleeve 75, as depicted in FIG. 4.

The present invention is directed to a split locking ring for wellhead components. In one illustrative embodiment, the device comprises a first internally threaded wellhead component, a second wellhead component, at least a portion of which is positioned within an opening in the first wellhead component, and a rotatable split lock ring comprised of at least two externally threaded sections, wherein at least a portion of the sections of the split lock ring are positioned between the first and second wellhead components and rotated to threadingly couple the sections of the split lock ring to the first wellhead component and thereby secure the second wellhead component to the first wellhead component.

In another illustrative embodiment, the device comprises a first internally threaded wellhead component, a second wellhead component, at least a portion of which is positioned within an opening in the first wellhead component, the second wellhead component having a flange, and a rotatable split lock ring comprised of two externally threaded sections, the sections having an end surface, wherein at least a portion of the sections of the split lock ring are positioned between the first and second wellhead components and rotated to threadingly couple the sections of the split lock ring to the first wellhead component and engage the end surface of the sections of the split lock ring with the flange on the second wellhead component, the sections thereby securing the second wellhead component to the first wellhead component.

In a further illustrative embodiment, the device comprises a first externally threaded wellhead component, an internally threaded sleeve threadingly coupled to the externally threaded first wellhead component, a second wellhead component, at least a portion of which is adapted to be positioned within an opening in the internally threaded sleeve, and a rotatable split lock ring comprised of at least two externally threaded sections, wherein at least a portion of the sections of the split lock ring are positioned between the internally threaded sleeve and the second wellhead component and rotated to threadingly couple the sections of the split lock ring to the internally threaded sleeve and thereby secure the second wellhead component to the first wellhead component.

In yet a further illustrative embodiment, the devices comprises a first externally threaded wellhead component, an internally threaded sleeve threadingly coupled to the externally threaded first wellhead component, the sleeve comprising a counterbore formed adjacent an end surface of the internally threaded sleeve, a second wellhead component, at least a portion of which is adapted to be positioned within an opening in the internally threaded sleeve, and a rotatable split lock ring comprised of at least two externally threaded sections, each of the sections having a flange, wherein at least a portion of the sections of the split lock ring are positioned between the internally threaded sleeve and the second wellhead component and rotated to threadingly couple the sections of the split lock ring to the internally threaded sleeve and thereby secure the second wellhead component to the first wellhead component, wherein at least a portion of the flange on each of the sections is positioned in the counterbore.

In one illustrative embodiment, the method comprises positioning at least a portion of a first wellhead component within an opening in a second internally threaded wellhead component, positioning a split lock ring comprised of at least two externally threaded sections proximate the first and second wellhead components, and rotating the sections of the split lock ring to threadingly couple the externally threaded sections to the internally threaded second wellhead component and position at least a portion of the split lock ring sections between the first and second wellhead components, thereby securing the first wellhead component to the second wellhead component.

In another illustrative embodiment, the method comprises positioning at least a portion of a first wellhead component within an opening in a second internally threaded wellhead component, the first wellhead component having a flange, positioning a split lock ring comprised of at least two externally threaded sections proximate the first and second wellhead components, and rotating the sections of the split lock ring to threadingly couple the externally threaded sections to the internally threaded second wellhead component and position at least a portion of the split lock ring sections between the first and second wellhead components, an end surface of each of the sections engaging the flange on the first wellhead component, the rotating of the sections being continued until the first wellhead component is securely coupled to the second wellhead component.

In a further illustrative embodiment, the method comprises threadingly coupling an internally threaded sleeve to an externally threaded first wellhead component, positioning at least a portion of a second wellhead component within an opening in the internally threaded sleeve, positioning a split lock ring comprised of at least two externally threaded sections proximate the internally threaded sleeve and the second wellhead component, and rotating the sections of the split lock ring to threadingly couple the sections to the internally threaded sleeve and position at least a portion of the split lock ring sections between the internally threaded sleeve and the second wellhead component, thereby securing the first wellhead component to the second wellhead component.

In yet a further illustrative embodiment, the method comprises threadingly coupling an internally threaded sleeve to an externally threaded first wellhead component, the internally threaded sleeve having a counterbore formed therein, positioning at least a portion of a second wellhead component within an opening in the internally threaded sleeve, the second wellhead component having a flange, positioning a split lock ring comprised of at least two externally threaded sections proximate the internally threaded sleeve and the second wellhead component, each of the sections having an end surface, and rotating the sections of the split lock ring to threadingly couple the sections to the internally threaded sleeve and position at least a portion of the split lock ring sections between the internally threaded sleeve and the second wellhead component, the end surfaces on the sections engaging the flange on the first wellhead component, the rotation being continued until such time as the first wellhead component is secured to the second wellhead component and at least a portion of a flange on each of the sections is positioned in the counterbore.

The particular embodiments disclosed above are illustrative only, as the invention may be modified and practiced in different but equivalent manners apparent to those skilled in the art having the benefit of the teachings herein. For example, the process steps set forth above may be performed in a different order. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

What is claimed is:

1. A device, comprising:

a first internally threaded wellhead production component;

a second wellhead production component having a longitudinal axis, at least a portion of which is positioned within an opening in said first wellhead production component, said second wellhead production component having a flange with an engagement surface that is approximately perpendicular to said longitudinal axis of said second wellhead production component; and a rotatable split lock ring having a longitudinal axis, said rotatable split lock ring being comprised of two externally threaded sections, said sections having an end surface that is approximately perpendicular to said longitudinal axis of said split lock ring, wherein at least a portion of said sections of said split lock ring are positioned between said first and second wellhead production components and rotated to threadingly couple said sections of said split lock ring to said first wellhead production component and abuttingly engage said end surface of said sections of said split lock ring with said engagement surface of said flange on said second wellhead production component, said sections thereby securing said second wellhead production component to said first wellhead production component.

2. The device of claim 1, wherein said first wellhead production component is selected from a group consisting of a wellhead, a riser, a casing head and a tubing head.

3. The device of claim 1, wherein said second wellhead production component is selected from a group consisting of a wellhead, a riser, a casing head and a tubing head.

4. The device of claim 1, wherein each of said sections of said split lock ring comprises at least one threaded opening and said device further comprises a set screw threadingly positioned within said threaded opening, an end of said set screw engaging said second wellhead production component.

5. The device of claim 1, wherein each of said sections of said split lock ring comprises a plurality of threaded openings and said device further comprises a set screw threadingly positioned within each of said plurality of threaded openings, an end of each of said set screws engaging said second wellhead production component.

6. The device of claim 1, wherein said internally threaded first wellhead component and said externally threaded sections of said split lock ring are comprised of ACME threads having a pitch of approximately four threads per inch.

7. A method, comprising:

performing a first step comprised of positioning at least a portion of a first wellhead production component within an opening in a second internally threaded wellhead production component, said first wellhead production component having a flange with an engagement surface that is approximately perpendicular to a longitudinal axis of the first wellhead production component;

after performing said first step, positioning a split lock ring comprised of at least two externally threaded sections proximate said first and second wellhead production components, said split lock ring having a longitudinal axis, said at least two externally threaded sections having an end surface that is approximately perpendicular to the longitudinal axis of the split lock ring; and rotating said sections of said split lock ring to threadingly couple said externally threaded sections to said internally threaded second wellhead production component and position at least a portion of said split lock ring sections between said first and second wellhead production components, the end surface of each of said sections of said split lock ring abuttingly engaging said engagement surface of said flange on said first wellhead production component, said rotating of said sections being continued until said first wellhead production component is securely coupled to said second wellhead production component.

8. The method of claim 7, further comprising positioning a threaded set screw in a threaded opening formed in each of said sections of said split lock ring until an end surface of said set screw engages a portion of said first wellhead production component.

9. The method of claim 7, wherein said step of rotating said sections of said split lock ring comprises positioning a threaded bar in a threaded opening formed in each of said sections of said split lock ring and applying a force to each of said threaded bars to thereby rotate said sections of said split lock ring.

10. The method of claim 7, wherein said first wellhead production component is selected from a group consisting of a wellhead, a riser, a casing head and a tubing head.

11. The method of claim 7, wherein said second wellhead production component is selected from a group consisting of a wellhead, a riser, a casing head and a tubing head.

12. The method of claim 7, wherein said internally threaded first wellhead production component and said externally threaded sections of said split lock ring are comprised of ACME threads having a pitch of approximately four threads per inch.

13. A device, comprising:

a first internally threaded wellhead production component;

a second wellhead production component, said second wellhead production component comprising first and second engagement surfaces;

a third structure, at least a portion of said second wellhead production component and said third structure being positioned within an opening in said first wellhead production component, said third structure comprising a third engagement surface that is adapted to engage said second engagement surface;

a rotatable split lock ring comprised of two externally threaded sections, said sections having an end surface, wherein at least a portion of said sections of said split lock ring are adapted to be positioned between said first and second wellhead production components and rotated to threadingly couple said sections of said split lock ring to said first wellhead production component and abuttingly engage said end surface of said sections of said split lock ring with said first engagement surface on said second wellhead production component, said sections thereby securing said second wellhead production component to said first wellhead production component;

a first seal between said second wellhead production component and said third structure; and a second seal between said first wellhead production component and said third structure.

14. The device of claim 13, wherein said first, second and third engagement surfaces are approximately perpendicular to a longitudinal axis of the first wellhead production component.

15. The device of claim 13, wherein said third structure extends through said second wellhead production component.

16. The device of claim 13, wherein said first seal engages an outer surface of said third structure.

17. The device of claim 16, wherein said first seal is positioned at least partially in a recess formed in said second wellhead production component.

18. The device of claim 13, wherein said second seal engages an inner surface of said first wellhead production component.

19. The device of claim 18, wherein said second seal is positioned at least partially in a recess formed in said third structure.

20. The device of claim 13, wherein a portion of said second wellhead production component is positioned between a portion of said third structure and a portion of said first wellhead production component.

* * * * *